United States Patent [19]

Paurat et al.

[11] 4,247,997

[45] Feb. 3, 1981

[54] TRENCH EXCAVATING AND SHORING APPARATUS

[76] Inventors: Friedrich W. Paurat, Kasselweg 29, 4230 Wesel 1; Roland Paurat, Lippestr. 32, 4223 Voerde, both of Fed. Rep. of Germany

[21] Appl. No.: 19,095

[22] Filed: Mar. 9, 1979

[30] Foreign Application Priority Data

Mar. 10, 1978 [DE] Fed. Rep. of Germany ..... 2810386

[51] Int. Cl.[3] ..... E02F 5/04; E02D 17/08

[52] U.S. Cl. ..... 37/82; 405/283

[58] Field of Search ..... 405/282, 283, 272; 37/82, 80 R, 81, 86

[56] References Cited

U.S. PATENT DOCUMENTS

| | | | |
|---|---|---|---|
| 96,824 | 11/1869 | McGehee | 37/82 |
| 606,987 | 7/1898 | Clark | 37/82 |
| 685,667 | 10/1901 | Bradshaw | 37/82 |
| 799,753 | 9/1905 | O'Connor | 37/82 |
| 2,545,016 | 3/1951 | Berry | 37/82 |
| 2,994,974 | 8/1961 | Domenighetti | 405/282 X |
| 3,750,409 | 8/1973 | Orfei | 405/283 |
| 3,820,345 | 6/1974 | Brecht | 405/283 |
| 4,173,836 | 11/1979 | Paurat | 37/81 |

FOREIGN PATENT DOCUMENTS

| | | | |
|---|---|---|---|
| 1634812 | 8/1970 | Fed. Rep. of Germany | 37/86 |
| 2450281 | 4/1976 | Fed. Rep. of Germany | 37/80 R |
| 1527923 | 4/1968 | France | 37/80 R |
| 2296057 | 7/1976 | France | 37/80 R |
| 35642 | 9/1911 | Sweden | 37/82 |

*Primary Examiner*—Clifford D. Crowder
*Attorney, Agent, or Firm*—Karl F. Ross

[57] ABSTRACT

A ditch-digging or trenching machine has a plurality of wall-engaging spreadable and retractable members which can be received in the trench to be advanced and provided with respective fluid-powered cylinders connectible to a cutting head for advancing the latter and drawing the retracted wall-engaging members thereafter to cut the trench. The cutter head includes a milling-type cutter in the form of a worm conveyor adapted to convey the detritus from the trench.

10 Claims, 6 Drawing Figures

TRENCH EXCAVATING AND SHORING APPARATUS

FIELD OF THE INVENTION

The present invention relates to a ditch-digging and trenching machine especially for hard ground, and, more particularly, to a machine for advancing a trench or ditch to be cut in the ground.

BACKGROUND OF THE INVENTION

Excavating machinery for the formation of ditches, trenches and the like have generally comprised a vehicular chassis adapted to be propelled on the ground ahead of a trench or ditch to be advanced or cut therein, and a cutting head which can be lowered from this chassis into the ground and drawn by a backward movement of the vehicular structure therealong to cut the trench in the ground.

Reference may be made to German patent publication (Auslegeschrift) No. DE-AS 27 00 950 (see also U.S. patent application Ser. No. 868,733, now U.S. Pat. No. 4,173,836, issued Nov. 13, 1979, and the art of record therein) which describes a ditching or trenching machine which has been found to be highly effective and which comprises a vehicular body which is propelled along the ground on tracks.

The rotary milling-type cutter of this machine is mounted on a cutting head or carrier which is articulated, in turn, to a boom, arm or outrigger swingable about horizontal and vertical axes to lower the cutting head into the ground and thereafter draw the cutting head along the path of the trench to be excavated upon movement of the vehicle rearwardly in the manner of a backhoe.

As noted, such machines have been found to be highly effective but, when deep trenches are to be excavated, especially large and expensive machines must be provided, and there is considerable concern regarding the stability of the machine because the reaction forces are applied over exceptionally long lever arms and distances to a support structure located well above and in advance of the face of the trench to be excavated.

Another difficulty with suuch systems, especially when deep excavations are to be made, is that removal of the detritus poses a problem.

It is customary, therefore, when deep and large trenches are to be excavated, to use a machine of the type described to break loose the advancing face of the trench wile another excavator, e.g. a bucket or backhoe excavator, is employed to lift the detritus from the trench.

OBJECTS OF THE INVENTION

It is the principal object of the present invention to provide an improved excavator, especially for relatively deep ditches and trenches in hard ground, which will avoid the disadvantages mentioned above and improve the efficiency of excavation.

Another object of the invention is to provide a low cost apparatus capable of advancing a trench or ditch at a high rate and which does not require boom or outrigger type equipment.

It is also an object of this invention to provide a ditch-digging or trenching machine having an improved distribution of forces and readily adaptable for the excavation of both deep and shallow trenches.

An object of the invention is also to provide an improved ditch or trenching machine which facilitates removal of any detritus from the trench or ditch without requiring an additional outrigger type excavator or bucket excavator.

Yet another object of the instant invention is to provide an improved machine for the purposes described which, over at least the major portion of the trench or ditch excavation need have no vehicular structure positioned above the ground.

SUMMARY OF THE INVENTION

These objects and others which will become apparent hereinafter are attained, in accordance with the present invention, in a ditch-digging and trenching machine which comprises a cutting head formed as a conveyor worm along the flight of which there are provided cutter picks and points adapted to mill the leading face of the trench and advance the resulting detritus upwardly therefrom, means for rotating the cutter in this cutting head, and a plurality of spreadable wall-engaging elements received in the trench rearwardly of the cutting head and connected to the latter by respective manipulating means for advancing the cutting head relative to the elements when the latter are spread to grip the inner walls of the trench and for drawing the elements behind the cutting heads when the latter are retracted from the walls of the trench.

As in a conventional excavator, therefore, the machine can comprise a support which can be advanced parallel to the trenching line, a milling-type trenching tool, a drive means for rotating the trenching tool, and a device between the support and the cutter head for positioning and controlling the latter, e.g. for advancing the cutting head against the face of the trench to be excavated.

However, for the cutting of trenches and ditches in hard ground, e.g. in rocky or stony ground, the support, according to the invention, comprises the aforementioned spreadable and retractable elements in the form of wall-engaging shields or plates which are received in the trench and, in a spread condition, grip the lateral walls thereof to resist reaction forces during advance of the cutting head. The aforementioned elements can thus be provided with a spreading device between the shields, e.g. a fluid-powered piston-and-cylinder arrangement.

The tool of the present invention is formed as a conveyor worm which is adapted to convey the detritus to the grade level along the full face of the trench to be excavated and is rotated approximately to lift the detritus in this manner. It has been found to be advantageous, as already noted, to form the flight or turns of this conveyor with picks, points or teeth so that they simultaneously excavate the face of the trench and produce the detritus which is conveyed away. Preferably this worm is inclined upwardly and either forwardly in the direction of advance of the trench or rearwardly.

The support and advancing device of the present invention can comprise a manipulating frame in which the worm is journaled and which can extend substantially the full length of the wall, carrying the motor which rotates the latter. The device may also include piston-and-cylinder arrangements connecting the frame with one or more of the spreadable elements for advancing the frame.

As has already been noted, the worm is journaled in the manipulating frame which extends the entire height of the trench face to be excavated while the motor can be mounted on the frame and lie above the trench.

According to an important feature of the invention, a horizontal conveyor is provided at grade level and at a discharge side of the conveyor worm, to collect the detritus raised by the conveyor worm and displace it out of the path of the advancing trench.

As soon as the conveyor worm is journaled in the manipulator frame, it can be partially surrounded, e.g. over its rear half turned away from the face of the trench which is cut away, with a semicylindrical apron or wall forming a conveyor cylinder and facilitating the advance of the detritus out of the trench.

According to a preferred embodiment of the invention, the support is provided on each side of the trench with vertically spaced wall-engaging shields, each pair of such shields at each level being provided with a respective power cylinder for advancing the frame. The power cylinders of each pair of shields, (or spreadable elements) can be pivotally connected to the respective spreadable elements and to the frame, detachably, while below the sheath of spreadable elements or pair of shields, a skid can be provided to ride upon the floor of the trench.

According to a feature of the invention, therefore, the advance of each power cylinder is terminated when the spreading device of the respective element or pair of shields is operated to disengage the shields from the wall so that the power cylinder can be used to advance the retracted spreadable elements or pair of shields toward the frame. Then the spreadable element is urged against the walls of the trench and the power cylinder again actuated to drive the cutting head forwardly while other pairs of shields or spreadable elements are successively drawn forwardly.

The trenching operation can be effected continuously because, while any one set of shields is being advanced, the others are anchored against the lateral walls of the trench and drive the cutting head forwardly.

Naturally, the faces of the shields confronting the trench walls can be provided with formations for improving the anchorage to these walls upon spreading of the shields apart.

Of course, the shields function not only as a support and advancing system for the cutting head, but also as temporary falsework or shuttering supports for the walls of the trench.

While in practice a conveyor worm of the aforedescribed type has been found to form a relatively clean and well defined floor for the trench, we have found it to be advantageous from time to time to provide at the end of the conveyor worm and below the frame, an additional milling or guide head which can cut a relatively clean floor.

The power cylinders are pivotally connected to the manipulating frame to control both the angular orientation and advance thereof.

The machine thus described has the advantage that the support structure for advacning of the cutting head can be received wholly in the trench and that no auxiliary boom-type excavator is required to recover detritus therefrom. The control of the various cylinders can be effected by conventional hydraulic valve systems which can be operated from above ground, the hydraulic controls being common in the art and in the forming of part of this invention. The system provides a self-propelled machine for cutting and clearing a trench with a minimum of auxiliary equipment and at low cost and the cutting head can be swung to any desired degree from a purely vertical orientation to a substantially horizontal orientation without difficulty.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
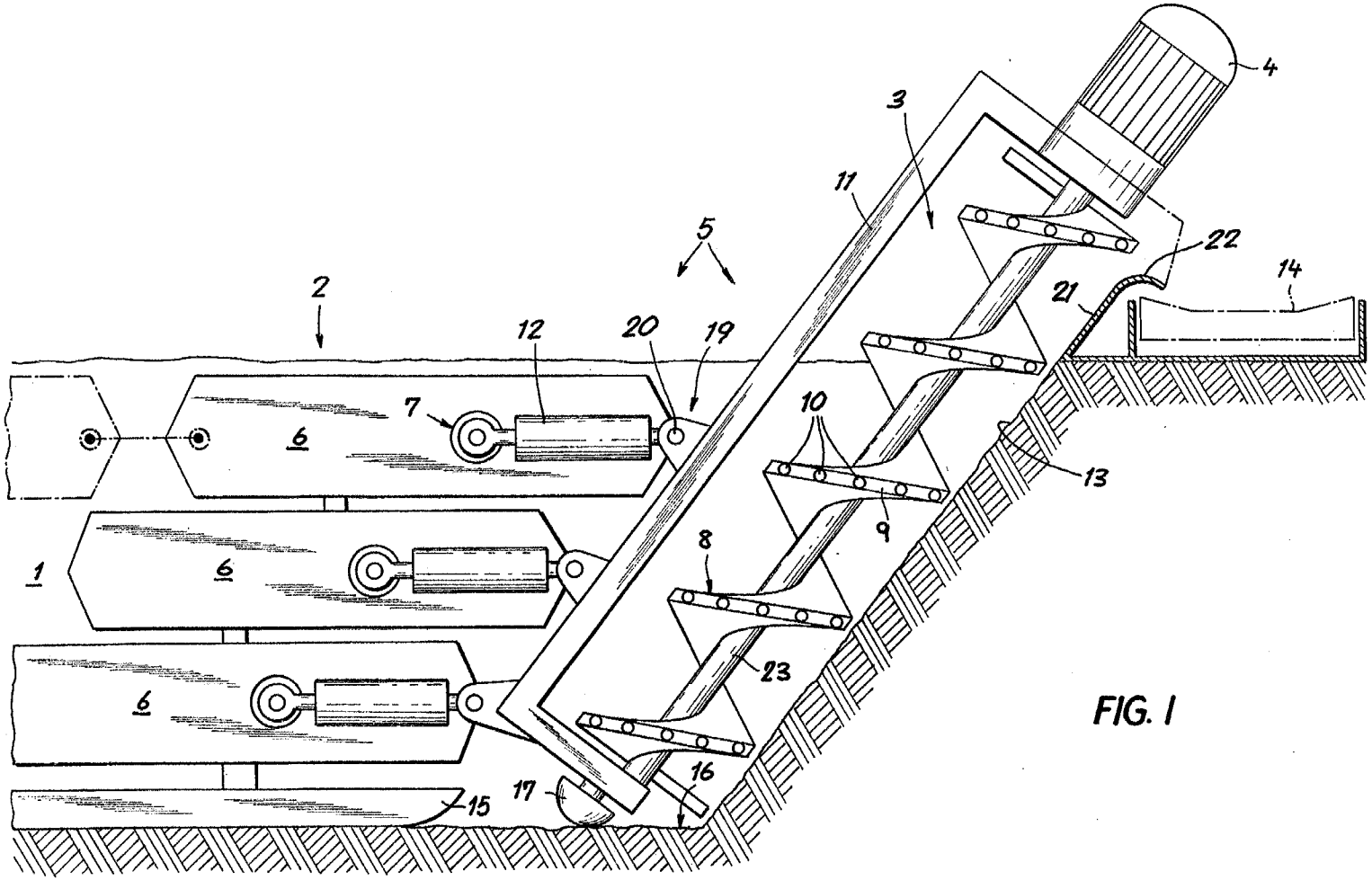
FIG. 1 is a diagrammatic side elevational view of an embodiment of a ditch-digging and trenching machine according to the invention.

In the drawing, similar parts of the two embodiments are identified with identical reference numerals and only the portions of the apparatus essential to the instant invention have been illustrated. Naturally, the cutter drive motor can be a hydraulic motor driven by a hydraulic pump whose prime mover, e.g. an internal combustion engine, may be located upon the ground at a location spaced from the trench and connected to the motor by hydraulic lines.

Similarly, hydraulic lines may be connected to the various piston-and-cylinder arrangements used in the present invention and can derive from a remote pump, being controlled by mechanical or electromagnetic valves to effect the various operations of the device under the control of an operator who can stand on the ground and look into the trench to monitor the progress. Alternatively, the valves may be programmed for partial or completely automatic control of the apparatus.

Figure 3:
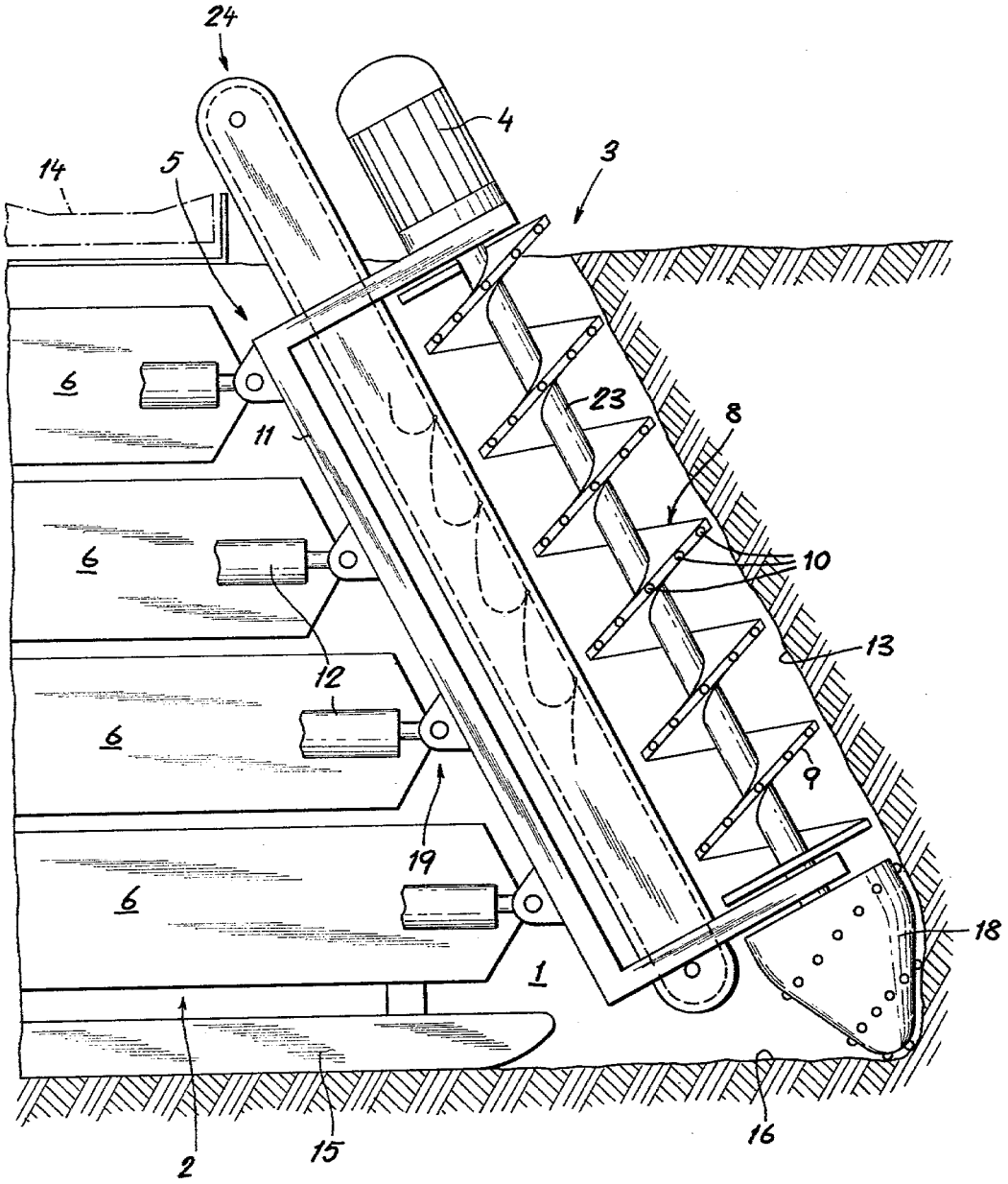
FIG. 3 is a view similar to FIG. 1 but illustrating another embodiment of the invention.

Basically the apparatus is intended to excavate a trench or ditch 1 in hard ground by advancing a cutter head in a predetermined direction to mill away the end face of the trench, i.e. the face 13 on the right hand side of the trench shown in FIGS. 1 and 3. The trenches are formed in hard ground, stone or rocky or stony terrain.

Thus the apparatus can comprise a support system 2 adapted to take up the reaction forces and with respect to which the cutting head can be advanced to propagate the trench. The tool has been represented at 3 and carries its drive 4 which can be in the form of a hydraulic motor. Between the support 2 and the tool 3, an advancing and manipulating system, represented, generally at 5, is provided. This system controls the advance and orientation of the tool 3.

Conventional trenching machines and corresponding units have a support generally in the form of a vehicle advancing along the ground while the control means 5 usually includes an outrigger as has previously been described.

In the system of the present invention, however, the support 2 is formed as spreadable elements 6 disposed one above the other and equipped with respective spreading devices as represented at 7. As can be seen from FIG. 2, each spreadable element 6 comprises a pair of wall-engaging shields 6a and 6b whose faces 6c and 6d confronting the walls 1a and 1b of the trench, can be provided with spike formations or the like for a better grip. The spreading means 7 can include one or more pairs of fluid-pressure cylinders 7a, 7b, each bearing upon one of the plates 6a, 6b and having pistons connected to a piston rod 7c which forms a pivot pin for an eye 12a of a respective power cylinder 12 to be described in greater detail below.

Thus, when the double acting cylinders 7a and 7b are energized in one direction, the shields 6a and 6b are pressed outwardly against the walls 1a and 1b and hence grip these walls to provide a support for the power cylinder 12. When the cylinders 7a and 7b are energized in the opposite direction, they are retracted from the walls and enable the cylinder 12 to move the spreadable element 6 parallel to the direction of advance of the trench.

The tool 3 of the present invention is formed as a conveyor worm 8 whose flight 9 is generally helical and is formed in its periphery with milling picks, teeth or points 10. According to an important feature of the invention, moreover, the advance and manipulating device 5 of the present invention includes a manipulating frame 11 and the power cylinders 12 which are provided between the frame 11 and the support 2.

The worm 8 is journaled in the frame 11 which extends over the entire height of the face 13 on the trench to be cut away, the drive 4 for this worm being disposed outwardly and above the trench.

Associated with the worm 8 above the trench 1 is a horizontal conveyor 14, e.g. a flight or belt conveyor, which carries the detritus away transversely to the direction of advance of the trench.

In the preferred embodiment or best mode embodiment of the present invention, illustrated in FIGS. 1, 2, 5 and 6, the support 2 along each wall 1a, 1b, is provided with a plurality of vertically spaced relatively movable spreadable elements 6 each having a pair of wall shields 6a, 6b and each forming a pivot, as has been described, for a cylinder-and-piston arrangement 12.

The lower spreadable element 6 is carried by a skid 15 slidable along the floor of the trench.

As shown in dot-dash lines in FIG. 1, each of the spreadable elements can be linked to rearwardly lying spreadable elements 6 so that additional support can be provided for each cylinder 12 or the addition and rearwardly lying spreadable elements can be used to support the walls 1a and 1b as a shutter or falsework.

In operation, while other spreadable elements continue to grip the walls 1a and 1b and during continuous drive of the cutter, the shields 6a and 6b of one spreadable element 6 are drawn inwardly and the double acting power cylinder 12 thereof is actuated to draw this element towards the frame. The shields are then spread outwardly to grip the walls and the power cylinder 12 energized in the opposite direction to apply said advancing pressure on the frame 11 and thereby drive the cutter into the face of the trench. The other spreadable elements can then be successively drawn toward the frame and reengaged with the walls of the trench so that a stepwise advance of the cutter is possible.

Figure 2:
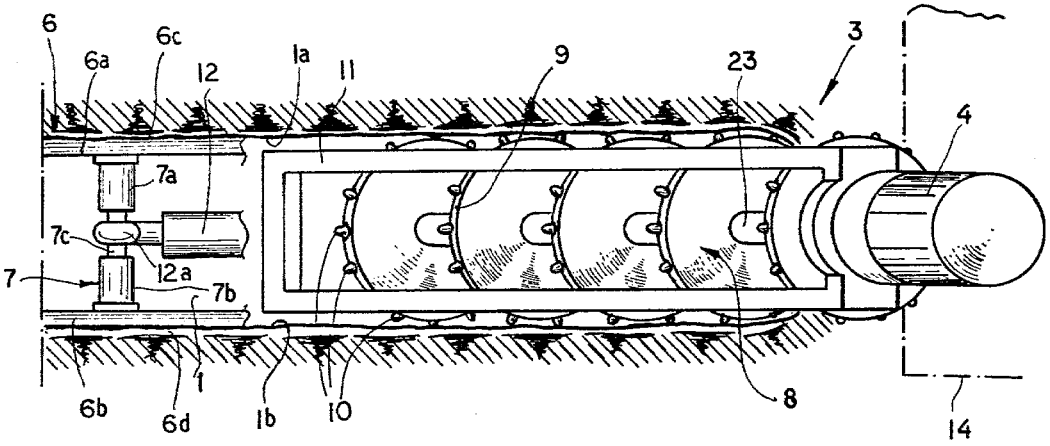
FIG. 2 is a plan view of the machine of FIG. 1.

In the embodiment of FIGS. 1 and 2, moreover, the cutting tool 3 is provided at the floor of the trench with a guide head 17 which enables the bottom of the cutter assembly to rest upon the ground. In the embodiment of FIG. 3, however, an additional milling head or cutter is provided at the bottom of the cutter.

Each of the cylinder arrangements 12 has its piston connected with the frame 11 by a pivot 19 from which the pintle or pivot pin can be withdrawn to allow separate positioning of the cutting head and of the support in the trench as will be apparent hereinafter. The pivot axes can be simple horizontal axes as shown at 20 although universal joints or so-called Cardan joints can be provided. Cardan joints increase the ability to pivot the cutting head in any desired direction, e.g. for advancing the trench along a curve path or the like. In this case, means can be provided to enable the system to generate steering movement, e.g. by providing the cylinders 12 in parallel pairs and articulating them to ends of a common lever which, in turn, is connected to the frame so as to be able to direct the latter to the left or to the right by extending one of the pistons of the pair more than the other.

According to another feature of the invention, the worm where it reaches out of the trench can be surrounded by or communicate with a feed chute 21 which deflects the detritus into the horizontal conveyor 14 over a discharge lip 22. In the embodiment of FIGS. 1 and 2, the worm 8 has its shaft 23 inclined forwardly and upwardly to the vertical so that the conveyor 14 can be located ahead of the trenching machine. In FIG. 3, the cutting head operates upon an undercut face 13 and thus is inclined upwardly and rearwardly with the conveyor 14 being located behind the worm. In this case a flight or bucket or pocket conveyor 24 can be mounted in the frame 11 behind the worm 8 to deposit the detritus in the conveyor 14.

Figure 4:
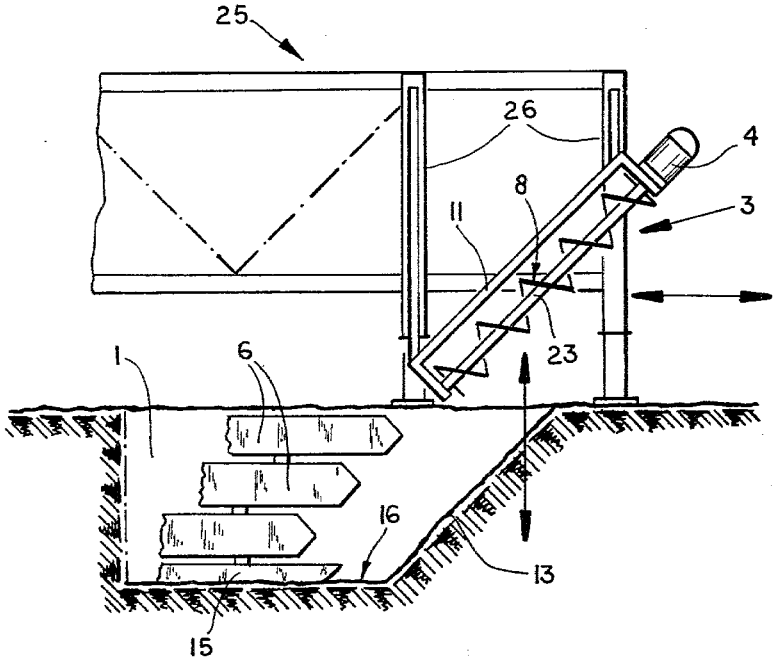
FIG. 4 is an illustration of a frame assembly for placing a device of the FIG. 1 or FIG. 3 construction in operation.

As will be apparent, before the apparatus described in connection with FIGS. 1 through 3 can be placed in operation, an initial portion of the trench must be formed or prepared. While this can be done by hand or with some other excavating machine, it has been found to be advantageous to provide a portal or bridge-type frame 25 adapted to straddle the initial portion of the trench to be formed and upon which the cutter head, consisting of the worm 8 and its drive 4 can be mounted. The head can be carried by cylinder arrangements 26 which lower the cutter into the ground in the inclined position shown in FIG. 4, whereupon the portal frame 25 can be advanced, to cut the starting portion of the trench. Naturally the cutter head can be moved horizontally on the frame if desired or the frame can be provided on a vehicle or as part of the vehicle, with the vehicle moving slowly to the right once the cutting head has been lowered. When a sufficient length of the trench has been cut, the spreadable elements 6 are inserted and the cylinders 12 thereof are coupled to the frame 11 by the replaceable pivots mentioned above. Naturally any such vehicle can advance only very slowly since it can only apply a fraction of the horizontal force to the cutting head which can be applied by the support 2.

Figure 5:
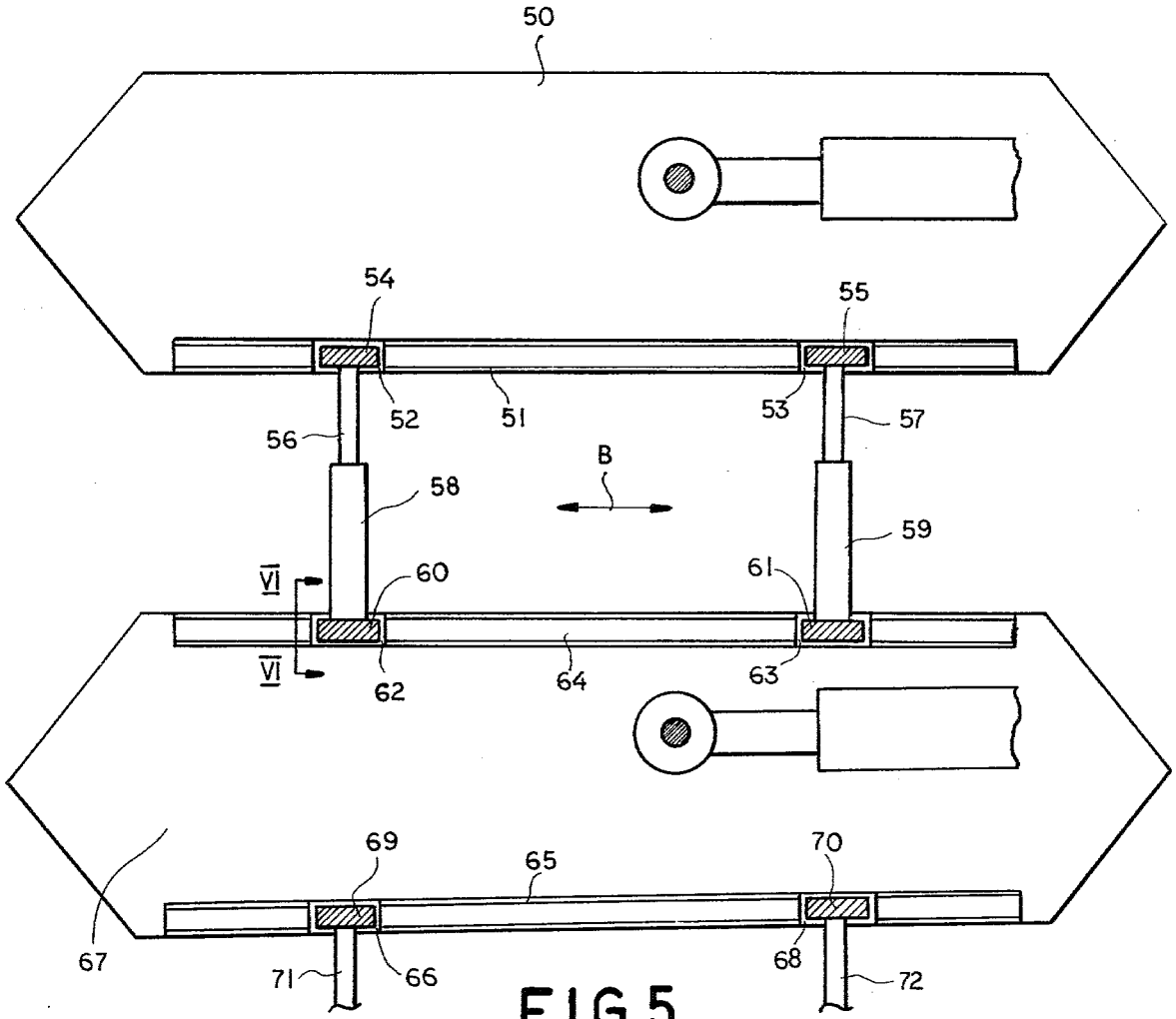
FIG. 5 is a diagrammatic detail view illustrating features of the shield assembly of the instant invention.
Figure 6:
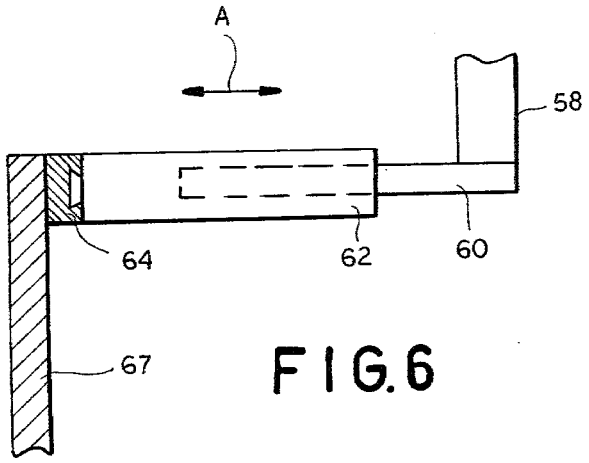
FIG. 6 is a fragmentary cross-sectional view taken along the lines VI—VI of FIG. 5.

As can be seen from FIGS. 5 and 6, the upper shield 50 of the uppermost spreadable element has a reinforcing bar 51 carrying a pair of sleeves 52, 53 which guide the shield on respective bars 54, 55 connected to pistons 56, 57 of cylinders 58, 59 on bars 60, 61 upon which the sleeves 62, 63 are slidable. Sleeves 62 and 63 are mounted upon the reinforcing bar 64 of the next lower shield 67 which also has a reinforcing bar 65 carrying sleeves 66, 68 guided on bars 69, 70 whose pistons 71, 72 and cylinders are connected to the next lower spreadable element etc. As can be seen in FIG. 6, this allows the vertical positions of the spreadable elements to be set in accordance with the height or depth of the trench, and also permit the shields (e.g. shield 67) to move outwardly and inwardly as represented by the arrow A. The reinforcing bars 64 form tracks for the ends of the channels to permit the spreadable elements to be shifted relative to one another in the direction of arrow B in the manner previously described.

We claim:

1. A ditch-digging and trenching machine comprising:

support means receivable in a trench to be advanced by the cutting of a face thereof, said trench having a pair of lateral walls, said support means including a plurality of spreadable elements disposed one above another and each comprising a pair of wall-engaging shields, and respective spreading means for urging the shields of said elements apart and against said lateral walls to grip the latter;

a cutter assembly adapted to be thrust against said face and including a frame extending substantially the height of said face, a worm conveyor journaled in said frame and having at least one flight provided with picks adapted to mill away said face and carry detritus therefrom to the surface, and drive means for rotating said worm conveyor.

a respective piston-and-cylinder arrangement connected between each of said spreadable elements and said frame and actuatable to force said worm conveyor against said face, said drive means being disposed out of said trench above grade, each of said piston-and-cylinder arrangements being actuatable independently of the piston-and-cylinder arrangements of the other spreadable elements; and a transverse conveyor receiving detritus from said worm conveyor above grade for carrying the detritus away from the trench.

2. The machine defined in claim 1 wherein each of said spreadable elements is connected to another spreadable element rearwardly thereof and engageable with the lateral walls of said trench.

3. The machine defined in claim 1 wherein said cutter assembly comprises a guide head on said frame engaging the floor of said trench.

4. The machine defined in claim 1 wherein said cutter assembly comprises a milling cutter connected to said frame for cutting away said face at the floor of said trench.

5. The machine defined in claim 1 wherein said piston-and-cylinder arrangements are pivotally connected to said frame.

6. The machine defined in claim 5 wherein said worm conveyor is provided above grade with a conveyor chute opening into said transverse conveyor.

7. The machine defined in claim 6 wherein said worm conveyor is inclined forwardly and upwardly in the direction of advance of the trench.

8. The machine defined in claim 5 wherein the worm is inclined rearwardly upwardly with respect to the direction of advance of the trench.

9. The machine defined in claim 8, further comprising a further conveyor extending along said frame paralel to said worm conveyor for carrying detritus to said transverse conveyor.

10. The machine defined in claim 1, further comprising a portal frame adapted to be positioned over a trenching line for lowering said assembly into the ground to form an initial length of the trench.

* * * * *